US010844309B2

(12) United States Patent
Ikejima et al.

(10) Patent No.: US 10,844,309 B2
(45) Date of Patent: Nov. 24, 2020

(54) GREASE COMPOSITION

(71) Applicants: Kyodo Yushi Co., Ltd., Fujisawa-shi, Kanagawa (JP); Denso Corporation, Kariya-shi, Aichi (JP)

(72) Inventors: Shozo Ikejima, Okazaki (JP); Iwaki Hirooka, Fujisawa (JP); Yutaka Imai, Suzuka (JP); Ryosuke Ichimura, Kawasaki (JP); Kazuki Isa, Fujisawa (JP); Yusuke Asada, Kariya (JP); Kyoji Inukai, Kariya (JP); Hiromasa Tanaka, Kariya (JP); Masashi Tobayama, Kariya (JP); Toshizo Watanabe, Kariya (JP)

(73) Assignees: KYODO YUSHI CO., LTD., Fujisawa (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 16/027,806

(22) Filed: Jul. 5, 2018

(65) Prior Publication Data

US 2019/0062664 A1 Feb. 28, 2019

(30) Foreign Application Priority Data

Aug. 23, 2017 (JP) ..... 2017-160123

(51) Int. Cl.

| | |
|---|---|
| ***C10M 169/02*** | (2006.01) |
| ***C10M 105/72*** | (2006.01) |
| ***C10M 113/12*** | (2006.01) |
| ***C10N 20/02*** | (2006.01) |
| ***C10N 20/06*** | (2006.01) |
| ***C10N 40/08*** | (2006.01) |
| ***C10N 50/10*** | (2006.01) |
| *C10N 30/02* | (2006.01) |
| *C10N 30/06* | (2006.01) |

(52) U.S. Cl.

CPC ..... *C10M 169/02* (2013.01); *C10M 105/72* (2013.01); *C10M 113/12* (2013.01); *C10M 2201/1056* (2013.01); *C10M 2203/1006* (2013.01); *C10M 2205/0285* (2013.01); *C10M 2207/2805* (2013.01); *C10M 2219/022* (2013.01); *C10M 2219/024* (2013.01); *C10M 2219/082* (2013.01); *C10M 2219/085* (2013.01); *C10M 2219/102* (2013.01); *C10N 2020/02* (2013.01); *C10N 2020/06* (2013.01); *C10N 2030/02* (2013.01); *C10N 2030/06* (2013.01); *C10N 2040/08* (2013.01); *C10N 2050/10* (2013.01)

(58) Field of Classification Search

CPC ..... C10M 169/02; C10M 105/72; C10M 113/12; C10M 2201/1056; C10M 2219/082; C10M 2219/085; C10M 2219/102; C10M 2203/1006; C10M 2205/0285; C10M 2207/2805; C10M 2219/022; C10M 2219/024; C10M 101/04; C10M 2219/00; C10N 2240/08; C10N 2250/10; C10N 2220/022; C10N 2220/082; C10N 2230/02; C10N 2230/06; C10N 2020/02; C10N 2020/06; C10N 2030/02; C10N 2030/06; C10N 2040/08; C10N 2050/10

See application file for complete search history.

(56) References Cited

U.S. PATENT DOCUMENTS

| | | | | | |
|---|---|---|---|---|---|
| 2,748,081 | A * | 5/1956 | Peterson | C10M 5/00 508/136 |
| 3,196,109 | A * | 7/1965 | Morway | C10M 169/00 508/155 |
| 3,208,940 | A | 9/1965 | Owens et al. | |
| 3,909,426 | A | 9/1975 | Horodysky et al. | |
| 5,462,683 | A * | 10/1995 | Kinoshita | C10M 169/00 508/137 |
| 5,708,069 | A * | 1/1998 | Burns | C08K 9/06 427/219 |
| 6,432,889 | B1 * | 8/2002 | Kinoshita | C10M 169/06 508/335 |
| 2008/0146474 | A1 | 6/2008 | Takahashi et al. | |

FOREIGN PATENT DOCUMENTS

| | | | | |
|---|---|---|---|---|
| DE | 1246920 | B | 8/1967 | |
| JP | 7-71483 | A | 3/1995 | |
| JP | 2006-152092 | A | 6/2006 | |
| JP | 5441905 | B2 * | 3/2014 | |
| WO | WO-2016066792 | A1 * | 5/2016 | C10M 169/00 |

OTHER PUBLICATIONS

Office Action issued by the German Patent Office in corresponding German Patent Application No. 102018116504.8 dated Oct. 14, 2019 (7 pages including partial English translation).

* cited by examiner

*Primary Examiner* — Pamela H Weiss

(74) *Attorney, Agent, or Firm* — Buchanan Ingersoll & Rooney PC

(57) ABSTRACT

Provided is a grease composition for a magnet clutch of an automobile, including: a base oil; and a thickener, wherein the composition contains 5% by mass or more of a sulfur content in terms of sulfur element relative to a total mass of the composition.

5 Claims, No Drawings

GREASE COMPOSITION

TECHNICAL FIELD

The invention relates to a grease composition which is favorably applicable to a lubricated part which requires high torque transmission performance and excellent adhesion prevention performance, specifically to a lubricated part and the like of an electromagnetic clutch for transmitting and shutting rotational power.

BACKGROUND ART

Conventionally, a compressor of a vehicle air conditioning apparatus receives a driving force via a belt from a drive engine, and its operation is usually controlled by ON and OFF of torque transmission triggered by ON and OFF of an electromagnetic clutch.

An electromagnetic clutch includes: a rotor (drive-side rotating body) being a magnetic material which is rotated by the rotational driving force outputted from the drive engine; an armature being a magnetic material which is rotated when connected to the rotor; and an electromagnet to produce an electromagnetic force which connects the rotor and the armature together when an electric current is passed therethrough. The armature is connected to a rotating shaft of the compressor via a hub. When the armature is attracted by the electromagnetic force of the electromagnet and then connects to the rotor, torque is transmitted and thus the rotating shaft of the compressor is rotated. In this way, the compressor operates.

When the rotor and the armature of the electromagnetic clutch connect to each other, attractive forces act on both magnetic materials through the contact surface, and both are joined to each other as a result. Since the surfaces of both magnetic materials are not smooth microscopically, both magnetic materials are in contact with each other at real contact points. Bonding (adhesion) takes place at the real contact points, and a shearing force necessary to separate them acts as a frictional force. A shearing or a fracture occurring at an adhesion point causes so-called adhesive wear, in which the material gradually wears away from the surface of the magnetic material, resulting in a rough surface. There is a problem that noise (so-called rough surface noise) occurs due to the rough surface. There is also a problem that, if the adhesive wear further continues, the slide surfaces eventually stick to each other to become inseparable.

For those reasons, a friction surface usually has lubricant applied thereon. Known lubricants include an extreme pressure lubricant containing phosphorus and sulfur (Patent Literature 1), a lubricating oil composition containing a phosphorus compound and a particular organic acid salt (Patent Literature 2), and the like.

CITATION LIST

Patent Literatures

[Patent Literature 1] Japanese Patent Application Publication No. Hei 7-71483

[Patent Literature 2] Japanese Patent Application Publication No. 2006-152092

SUMMARY OF INVENTION

Technical Problems

In response to the recent weight reduction of automobiles, electromagnetic clutches are also required to reduce in size and weight. As a result, use conditions are becoming severe. Under such circumstances, electromagnetic clutches are required to have higher torque transmission performance and better adhesion prevention performance compared to conventional ones.

Thus, a problem to be solved by the invention is to provide a grease composition which has both high torque transmission performance and excellent adhesion prevention performance.

Solution to Problems

The present inventors found that it was possible to deal with this problem by using a grease composition containing a sulfur content in a particular amount or more in the grease. To be more specific, the invention provides the following grease composition:

1. A grease composition for a magnet clutch of an automobile, comprising a base oil, and a thickener, wherein the composition contains 5% by mass or more of a sulfur content in terms of sulfur element relative to a total mass of the composition.
2. The grease composition according to 1 described above, wherein the base oil is at least one selected from fatty acid sulfides, sulfurized oils and fats, and polysulfides.
3. The grease composition according to 1 or 2 described above, wherein the thickener comprises a metal oxide.
4. The grease composition according to 3 described above, wherein the metal oxide is silica.
5. The grease composition according to 4 described above, wherein a primary particle diameter of the silica is 300 nm or less.
6. The grease composition according to any one of 1 to 5 described above, wherein the sulfur content in terms of sulfur element is 50% by mass or less relative to the total mass of the grease composition.
7. The grease composition according to any one of 1 to 6 described above, wherein the base oil is sulfurized oils and fats represented by formula (1) or (2):

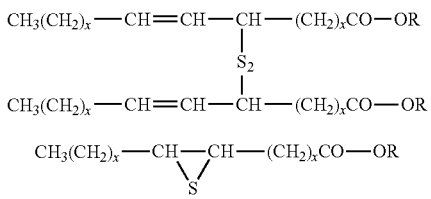

(1)

(2)

wherein R is a hydrocarbon group and x is a number equal to or greater than 1.

8. The grease composition according to any one of 1 to 6 described above, wherein the base oil is polysulfide represented by any one of formulas (3) to (6):

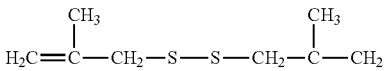

(3)

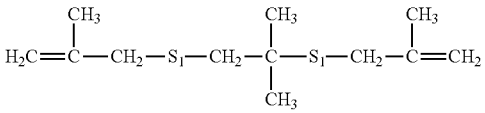

(4)

-continued (5)

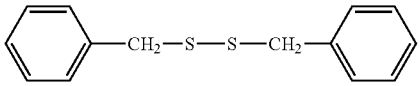

(6)

wherein R is a hydrocarbon group.

9. The grease composition according to any one of 1 to 8 described above, wherein the ratio of the base oil in the composition of the invention is 50 to 95% by mass relative to the total mass of the composition.

10. The grease composition according to any one of 1 to 9 described above, wherein the content of the thickener is 5 to 25% by mass relative to the total mass of the grease composition of the invention.

Advantageous Effects of Invention

The grease composition of the invention is excellent in torque transmission property and adhesion prevention property.

DESCRIPTION OF EMBODIMENTS

The grease composition of the invention contains 5% by mass or more of a sulfur content in terms of the sulfur element.

From the viewpoints of torque transmission property and adhesion prevention property, the sulfur content of the invention is preferably 5% by mass or more, more preferably 10% by mass or more, further preferably 20% by mass or more, and most preferably 30% by mass in terms of the sulfur element. From the viewpoint of anti-corrosion property, the sulfur content is preferably 50% by mass or less.

As the base oil used in the invention, it is possible to employ a sulfur-based compound having a sulfur atom in its structure. Such a sulfur-based compound is preferably at least one selected from fatty acid sulfides, sulfurized oils and fats, and polysulfides, and more preferably sulfurized oils and fats and polysulfides.

The fatty acid sulfides refer to sulfides of fatty acids. Representative compounds are represented by formula (1) or (2) below (in the formulas, R is H and x is a number equal to or greater than 1). The fatty acid sulfides commercially available include, for example, DAILUBE GS-550 and DAILUBE GS-520 (these are manufactured by DIC Corporation), Additin RC2715 (manufactured by Rhein Chemie), and SOR-B (manufactured by Maruni Seiyu Co., Ltd.).

The sulfurized oils and fats are also referred to as ester sulfides and refer to sulfides of fatty acid glycerin esters and fatty acid esters. Representative compounds are represented by formula (1) or (2) below (in the formulas, R is a hydrocarbon group and x is a number equal to or greater than 1). The sulfurized oils and fats or ester sulfides commercially available include, for example, DAILUBE GS-110, DAILUBE GS-210, DAILUBE GS-240, DAILUBE GS-215, DAILUBE GS-225, DAILUBE GS-235, DAILUBE GS-235S, DAILUBE GS-245, and DAILUBE FS-200 (these are manufactured by DIC Corporation), Additin RC2411, Additin RC2415, Additin RC2418, Additin RC2310, Additin RC2315, and Additin RC2317 (these are manufactured by Rhein Chemie), and L-18A and 10B (these are manufactured by Maruni Seiyu Co., Ltd.).

The polysulfides refer to compounds represented by the general formula R—Sn—R' (in the formula, R and R' may be identical to each other or different from each other and represent hydrocarbon groups such as linear chain or branched alkyl groups (the alkyl group may be substituted with an aromatic ring such as a phenyl group or a cycloalkane such as a cyclohexyl group and/or may contain a hetero atom such as sulfur in the chain), and n is a number equal to or greater than 2). Note that the case where a sulfide of olefin is a mixture is referred to as an olefin sulfide, and it appears that the case where that the sulfide is a single unit is defined separate from polysulfides. The present specification does not make a distinction between them depending on whether the sulfide is a mixture or a single unit and deals with olefin sulfides as a sub-concept of polysulfides. Representative polysulfides are represented by formulas (3) to (6) below (in the formulas, R is a hydrocarbon group). The polysulfides commercially available include, for example, DAILUBE IS-30, DAILUBE IS-35, DAILUBE GS-440L, and DAILUBE GS-420 (these are manufactured by DIC Corporation), Additin RC2520, Additin RC2540, Additin RC2541, and Additin RC2940 (these are manufactured by Rhein Chemie), TNPS537 and TBPS454 (these are manufactured by Chevron Phillips Chemical), and TPS32 and TPS44 (manufactured by Arkema). There is a case where a polyolefin whose hydrocarbon moiety is composed only of olefin is particularly referred to as an olefin sulfide.

(1)

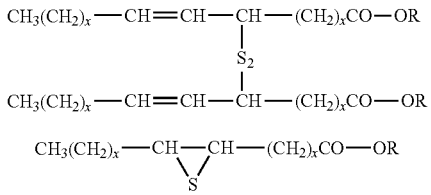

(2)

(3)

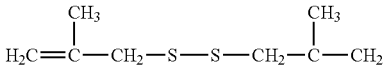

(4)

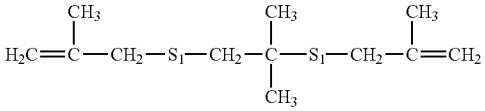

(5)

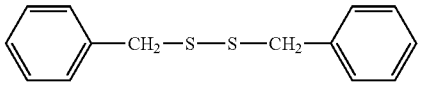

(6)

As long as the sulfur content is 5% by mass or more in terms of sulfur element, the composition of the invention may further contain another base oil usually used in grease, in addition to a synthetic oil having a sulfur atom in its structure. The base oils which can be employed together include mineral oils and synthetic oils, for example ester-based synthetic oils represented by diesters and polyol esters; synthetic hydrocarbon oils such as poly α olefin (PAO) and polybutene; ether-based synthetic oils represented by alkyl diphenyl ether, dialkyl diphenyl ether, and polypropylene glycol; silicone oils; and fluorinated oils.

The kinematic viscosity of the base oil of the invention at 40° C. is preferably 10 to 200 $mm^2/s$, more preferably 15 to 100 $mm^2/s$, and further preferably 20 to 50 $mm^2/s$ from the viewpoints of heat resistance and low-temperature property. Note that in the present specification, the kinematic viscosity refers to a value measured in accordance with JIS K2220 23.

The ratio of the base oil in the composition of the invention is preferably 50 to 95% by mass, more preferably 75 to 95% by mass, and further preferably 85 to 95% by mass relative to the total mass of the composition.

The thickener which can be used in the invention is not particularly limited. Specific examples include soap-based thickeners represented by Li soap and complex Li soap, urea-based thickeners represented by diurea, inorganic-based thickeners represented by silica, organic-based thickeners represented by polytetrafluoroethylene (PTFE), and the like. From the viewpoint of torque transmission property, the thickener preferably contains a urea-based thickener such as urea or an inorganic-based thickener such as silica, and more preferably contains an inorganic-based thickener such as silica. The thickener further preferably contains silica. Most preferably, the thickener is composed only of silica.

From the viewpoint of wear resistance, the silica used as the thickener in the invention has a primary particle diameter of preferably 300 nm or less, more preferably 100 nm or less, and further preferably 50 nm or less. From the viewpoint of torque transmission property, 5 nm or more is preferable and about 10 to 12 μM is particularly preferable. Note that in the present specification, the primary particle diameter of silica refers to the average value obtained by analyzing the particle diameter using a photo of electron microscope observation.

The silica used as the thickener in the invention may be hydrophobically surface treated with silane or the like. From the viewpoint of water resistance, ones treated with dimethyldichlorosilane are preferable.

The content of the thickener is preferably 5 to 25% by mass and more preferably 7 to 20% by mass relative to the total mass of the grease composition of the invention. In the case of 5% by mass or more, the grease has an appropriate consistency and leakage from the lubricated part is prevented, making it possible to satisfy a sufficient lubrication lifetime. On the other hand, in the case of 25% by mass or less, a preferable fluidity is guaranteed and inflow into the lubricated part is smooth, making it possible to satisfy a sufficient lubricity.

The grease composition of the invention may be added with general purpose additives as necessary and may contain, for example, a rust preventative, a load carrying additive, an oxidation inhibitor, and the like as necessary. The rust preventative includes, for example, organic sulfonates such as zinc sulfonate and calcium sulfonate. The load carrying additive includes, for example, molybdenum disulfide, dithiophosphates, and dithiocarbamates. The sulfur content of the invention may be derived from additive. The oxidation inhibitor includes an amine-based oxidation inhibitor and a phenol-based oxidation inhibitor. The content of these optional additives is usually 0.5 to 5% by mass relative to the total mass of the grease composition of the invention.

The worked penetration of the grease composition of the invention is adjusted according to the usage purpose and is preferably 200 to 400. From the viewpoints of leakage property and fluidity into the lubricated part, 250 to 350 is more preferable. Note that the worked penetration in the present specification refers to the 60-stroke worked penetration measured in accordance with JIS K 2220 7.

The grease composition of the invention is preferably used in a lubricated part which requires a high coefficient of friction and an excellent adhesion prevention property, specifically in a lubricated part of a clutch or a torque limiter mechanism, and more specifically in a magnet clutch of an automobile. The surface of the lubricated part is preferably a member made of steel.

EXAMPLES

Preparation of Grease Composition

Examples 1 to 3 and 5 to 7 and Comparative Examples 1 to 4

The thickener and the base oil shown in Table 1 and Table 2 were mixed in the container and then the temperature thereof was raised and cooled with stirring. Thus, a base grease was obtained. Preparation was carried out such that the obtained base grease was kneaded with a triple roll mill to set the 60-stroke worked penetration (testing method JIS K2220 7.) to 300. Thus, a grease composition was obtained.

Example 4

In the base oil shown in Table 1, 2 moles of octadecylamine were reacted with 1 mole of 4.4'-diphenylmethane diisocyanate. Thus, a base grease was obtained. Preparation was carried out such that the obtained base grease was kneaded with a triple roll mill to set the 60-stroke worked penetration (testing method JIS K2220 7.) to 300. Thus, a grease composition was obtained.

The grease compositions prepared above were provided for the tests below. Table 1 and Table 2 show the test results.

[Torque Transmission Performance]

A line contact type friction and wear tester is used in the testing. A test piece is brought into surface contact with the other test piece, and then the test pieces are rotated while applying a load thereto. In this way, the maximum coefficient of friction at the initial stage of the start of testing is obtained from the frictional force produced.

The test conditions are as follows.

load: 900 N rotational speed: 1 rpm determination criteria:

$0.13 \leq \mu$ ○○○

$0.11 \leq \mu < 0.13$ ○○

$0.09 \leq \mu < 0.11$ ○

$\mu < 0.09$ x

[Adhesion Prevention Performance]

A line contact type friction and wear tester is used in the testing. A test piece is brought into line contact with the other test piece, and then the test pieces are rotated while applying a load thereto. The load was gradually increased, and the critical load, at which the coefficient of friction does not increase from 0.5 or higher, is measured.

The test conditions are as follows.

rotational speed: 500 rpm determination criteria:

500N≤critical load ○○

400N≤critical load<500N ○ critical load<400N x

[Measurement of Sulfur Content]

The sulfur content in the grease composition was measured in accordance with JIS K 2541-3. The mass percentages in Table 1 and Table 2 are each a value relative to the total mass of the grease composition.

[Measurement of Kinematic Viscosity of Base Oil]

The kinematic viscosity of the base oil at 40° C. was measured in accordance with JIS K2220 23.

TABLE 1

| | Ex. 1 | Ex. 2 | Ex. 3 | Ex. 4 | Ex. 5 | Ex. 6 | Ex. 7 |
|---|---|---|---|---|---|---|---|
| Thickener Type | Silica | Silica | Silica | Urea | Li Stearate | PTFE | Alumina |
| Type of Base Oil | Polysulfide | Fatty Acid Sulfide | Sulfurized Oil and Fat | Polysulfide | Polysulfide | Polysulfide | Polysulfide |
| S, mass % | 30.6 | 8.8 | 7.9 | 30.6 | 30.6 | 30.6 | 30.6 |
| Torque Transmission Performance | 0.135 | 0.121 | 0.117 | 0.105 | 0.095 | 0.098 | 0.155 |
| Coefficient of Friction μ | ○○○ | ○○ | ○○ | ○ | ○ | ○ | ○○○ |
| Adhesion Prevention Performance | 500 | 550 | 700 | 500 | 550 | 500 | 400 |
| Non-Adhesion Load, N | ○○ | ○○ | ○○ | ○○ | ○○ | ○○ | ○ |
| Overall Determination | ○ | ○ | ○ | ○ | ○ | ○ | ○ |

TABLE 2

| | Comp. Ex. 1 | Comp. Ex. 2 | Comp. Ex. 3 | Comp. Ex. 4 |
|---|---|---|---|---|
| Thickener Type | Silica | Silica | Silica | Silica |
| Type of Base Oil | Mineral Oil | PAO | Ester | Mineral Oil (90%) Polysulfide (10%) |
| S, mass % | 0.3 | 0 | 0 | 3.1 |
| Torque Transmission Performance | 0.081 | 0.075 | 0.072 | 0.089 |
| Friction Coefficient μ | x | x | x | x |
| Adhesion Prevention Performance | 200 | 200 | 250 | 300 |
| Non-Adhesion Load, N | x | x | x | x |
| Overall Determination | x | x | x | x |

The invention claimed is:

1. A grease composition for a magnet clutch of an automobile, comprising:

50 to 95% by mass of a base oil;

a thickener, and, optionally a sulfur-containing additive, wherein the base oil comprises a synthetic base oil having a sulfur atom in its structure selected from the group consisting of fatty acid sulfides and polysulfides, the base oil optionally comprises another base oil selected from the group consisting of mineral oils, ester-based synthetic oils, synthetic hydrocarbon oils, ether-based synthetic oils, silicone oils and fluorinated oils, the base oil which optionally comprises the another base oil has a kinematic viscosity at 40° C. of 10 to 200 $mm^2/s$, the composition contains 20% by mass or more of a sulfur content derived from the synthetic base oil and the optional sulfur-containing additive in terms of sulfur element total mass of the composition, and the thickener is silica treated with dimethyldichlorosilane.

2. The grease composition according to claim 1, wherein a primary particle diameter of the silica is 300 nm or less.

3. The grease composition according to claim 1, wherein the sulfur content in terms of sulfur element is 50% by mass or less relative to the total mass of the grease composition.

4. The grease composition according to claim 1, wherein the synthetic base oil is polysulfide represented by any one of formulas (3) to (6):

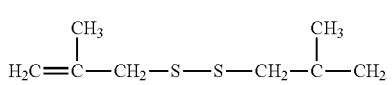

(3)

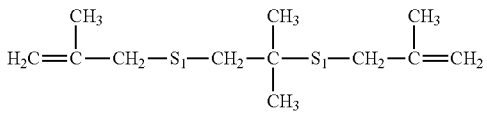

(4)

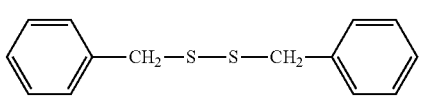

(5)

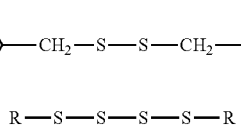

(6)

wherein R is a hydrocarbon group.

5. The grease composition according to claim 1, wherein the content of the thickener is 5 to 25% by mass relative to the total mass of the grease composition of the invention.

* * * * *